United States Patent [19]

Olsson

[11] 3,991,403

[45] Nov. 9, 1976

[54] INFORMATION TRANSMISSION EQUIPMENT

[75] Inventor: Kjell Olow Ingemar Olsson, Jarfalla, Sweden

[73] Assignee: U.S. Philips Corporation, New York, N.Y.

[22] Filed: Mar. 24, 1975

[21] Appl. No.: 561,190

[30] Foreign Application Priority Data

Mar. 25, 1974 Sweden ..... 74039892

[52] U.S. Cl. ..... 340/147 R; 340/38 L; 340/47; 340/171 PF

[51] Int. Cl.[2] ..... G08G 1/00; B61L 3/00; H04Q 9/00; H04Q 9/12

[58] Field of Search ..... 340/147 R, 171 PF, 345, 340/164 R, 365 L, 365 R, 348, 354, 256, 253 P, 253 B, 253 Q, 251, 248 D, 409, 188 CH, 195, 47, 38 L, 164 K

[56] References Cited

UNITED STATES PATENTS

| | | | |
|---|---|---|---|
| 3,573,807 | 4/1971 | Osborne | 340/365 L |
| 3,587,048 | 6/1971 | Brown, Jr. | 340/147 R |
| 3,740,745 | 6/1973 | Chao | 340/365 L |
| 3,863,206 | 1/1975 | Rabie | 340/38 L |
| 3,867,573 | 2/1975 | Birkin | 340/47 X |
| 3,885,228 | 5/1975 | Katz | 340/47 |

*Primary Examiner*—Donald J. Yusko
*Attorney, Agent, or Firm*—Frank R. Trifari; George B. Berka

[57] ABSTRACT

A device for transmitting a coded information about an actual signal condition of a signalling system, in which a plurality of conductor pairs are energized from assigned a.c. power sources upon actuation of corresponding signal devices, separation transformers each having a plurality of secondary windings are connected to respective conductor pairs and signals from the secondary windings are rectified and fed to assigned inputs of a code unit.

4 Claims, 2 Drawing Figures

INFORMATION TRANSMISSION EQUIPMENT

Figure 1:
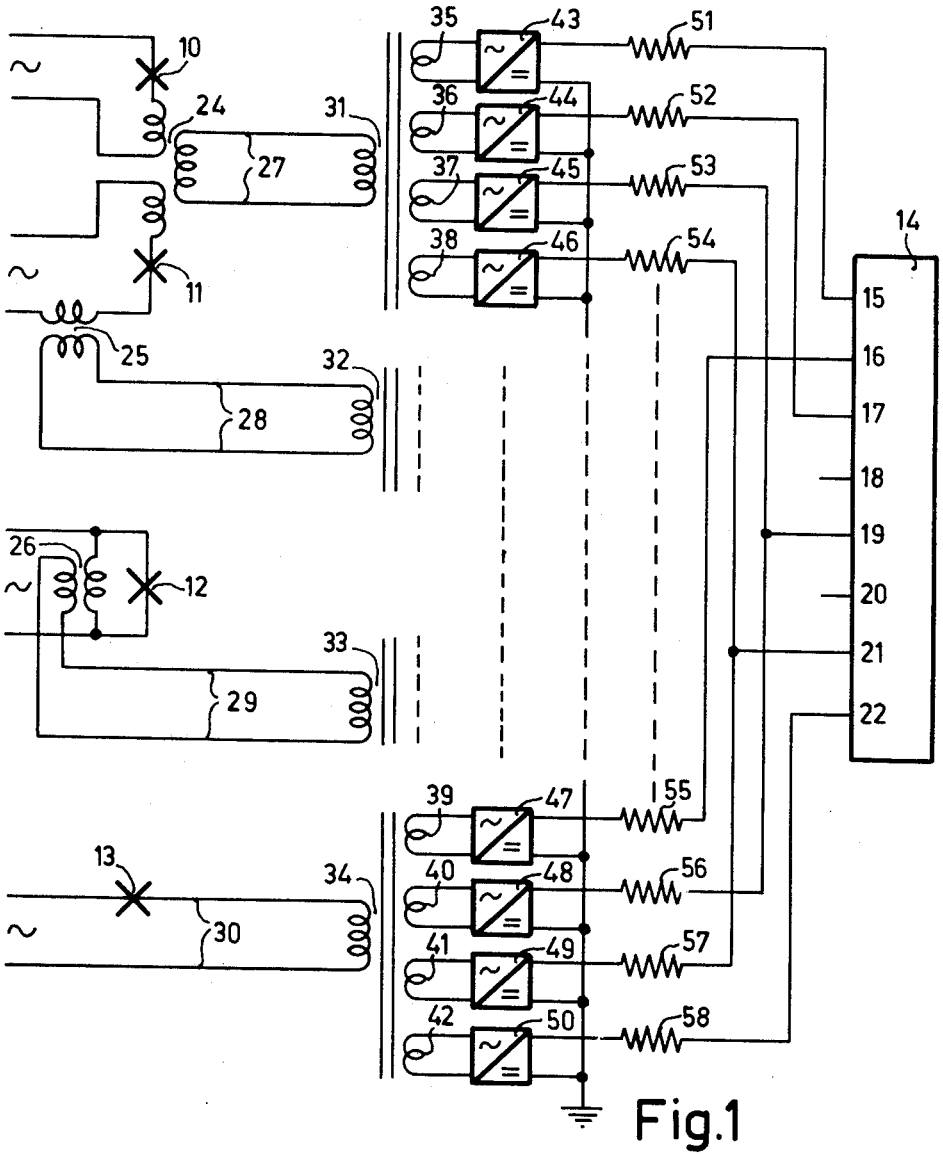

The invention relates to an information transmission equipment for transmitting information relating to different signal conditions from a transmitter station to a receiver station by means of a coded electromagnetic signal. More particularly it relates to an equipment for transmitting information about the condition of optical signals in railways to a receiver within the locomotive. The information transmitted by the coded electromagnetic signal shall comprise the same information as the optical signal and will be complementary to the same or in certain cases it can replace such an optical signal.

The information can refer to a "stop", a warning for a following "stop", information about maximum speed etc. It is then important to ensure that unavoidable component errors, which can arise in the transmitter station, do not result in transmission of an erroneous information. In particular it is important to ensure that an erroneous code is not transmitted, which represents a lower degree of restriction than the correct code. The most restrictive signal is the signal indicating "stop". The unavoidable errors, which can arise, therefore always must have a certain direction, either such that a condition is discovered as being an error condition or, if an erroneous code is transmitted, this code represents a more restrictive condition than the correct code.

It is assumed that each signal condition is represented thereby that voltage is appearing upon a certain signal line or conductor, which is specific for the actual condition, each signal condition having such a signal line on which voltage appears, when the signal condition in question prevails, while the remaining lines have no voltage.

The problem thus consists in converting these voltages, which are characteristic for each signal condition, to control information for a code unit included in the transmitter station in such manner, that arising component errors cannot lead to transmission of codes, which can be apprehended as correct codes but which give an erroneous information.

As code unit is according to the invention selected such a unit, which has a number of $m$ parallel inputs, of which inputs in each signal condition a given number of $n$ inputs ($n$ $m$) shall have voltage and the remaining ones shall have no voltage, and certain ones of the inputs, which shall have voltage, being common for the different conditions. These common inputs of the code unit thus are supplied from different feeding points (signal conductors), which must be separated such that voltage in one feeding point is not transferred to another feeding point via such a common input and voltage thus is applied to a number of inputs in the code unit, which shall not have voltage.

According to a previous proposal the $n$ different inputs are voltage supplied through $n$ diodes connected in parallel and having a common point connected to the respective signal conductor, on which the information voltage appears. This, however, involves the risk that, if short circuiting arises in one of the diodes connected to a common input, voltage can be transferred via this short circuited diode to a number of further inputs belonging to another signal condition. If then at the same time interruption occurs in as many diodes as the said number of further inputs, which receive voltage, this can result in that the code unit will have an apparently correct excitation and a code being transmitted, which appears like a correct code but which gives erroneous information.

According to the invention each signal conductor is selectively connected to those $n$ inputs, which shall have voltage from the actual signal conductor, via a transformer having a primary winding connected to the signal conductor, possibly, if the signal conductor has dc voltage, through an oscillator, and $n$ separate secondary windings each connected via a rectifier to the $n$ inputs of the code unit.

As a result of the galvanic separation between the different inputs of the code unit achieved by the feeding through separate secondary windings, a component error, for example in the rectifiers, cannot result in that dc voltage from an input having voltage is transferred to another input, which shall not have voltage. Appearing errors can only result in that inputs, which shall have voltage in the actual signal condition, will loose their voltage which can be allowed according to the rule of trying to achieve a more restrictive signal.

A further great advantage with the transformer feeding according to the invention is that no galvanic connection exists between the code unit and the signal conductors. If the signal conductors lead directly to the supply current circuits for the lamps in an optical railway signal system short circuiting to earth in the code unit or its supply circuit will thus not influence the optical signal system.

In order to prevent that ac voltage components if any can be transferred to another input of the code unit through the secondary windings on the transformers, these secondary windings shall furthermore have a low coupling to each other and may for this purpose be arranged on different legs of a transformer core or have a high impedence connected in series with the windings.

The invention is illustrated in the accompanying drawing in which

Figure 2:
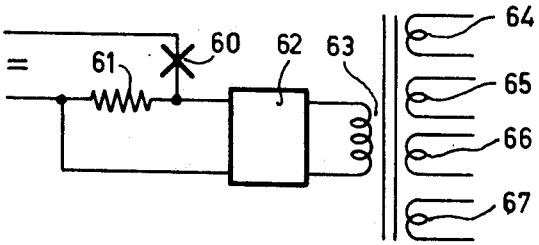

FIG. 1 is a circuit diagram, partly shown as a block diagram, for the control information part of an information transmission equipment according to the invention in the case of using ac indication lamps, the condition of which forms the basic information to be transferred and FIG. 2 shows an alternative connection to the indication lamps in the case of using dc lamps.

In FIG. 1 reference numerals 10, 11, 12 and 13 designate four signal lamps in an optical railway signal system, which lamps in dependence upon their excitation supply different information to the driver in a train passing the signal system. The lamps are excited by means of a control device (not shown) in such manner that for each signal condition the corresponding information is supplied to the driver.

In order to improve the security this optical signal system is combined with an electromagnetic information transmission equipment, which transfers the same information to the inner of the locomotive as the optical system but without the assistance of the driver. The electromagnetic transmission equipment may for example be of the kind as described in the Swedish Pat. No. 7315348-8 and adapted to transmit a binary coded signal, which is determined by a code unit 14. The code unit has a number $m$, in the example eight, inputs 15–22 to which control information in the shape of dc voltages is to be fed. The transmitted code then is, determined by voltage conditions on respective inputs.

The codes used in the present case are selected such that they correspond to a condition, in which a certain number *n* of the inputs of the code unit, in the example four inputs of the eight inputs, have voltage while the remaining inputs have no voltage. The advantage with this restriction on the used codes is that all errors, which result in that a number of inputs, different from four, receive voltage in the code unit which can be discovered as being an error condition.

The code unit may comprise a shift register the individual stages of which are set in parallel by means of the said applied dc voltages, or a number of oscillators which are triggered in parallel by the applied voltages. In the said first case the transmitted coded signal will be a pulse time sequence, in which the sequence of ones and zeros is obtained under shifting the content in the register and thus is determined by the said content. In the said last case the transmitted coded signal will be a multi-frequency signal containing a number of frequencies among a number of possible frequencies.

The control voltages applied to the code unit 14 shall as mentioned represent the signal condition given by the lamps 10–13. The four signal conditions are assumed to consist in that 1) the first lamp 10 is lighted alone, 2) the lamps 10 and 11 are lighted simultaneously, 3) the lamp 12 is lighted alone and 4) the lamp 13 is lighted alone. For detecting the operation condition of the lamps, as regards the three first lamps 10–12, transformers 24–26 are arranged with their primary windings connected in the supply current circuits for the lamps and their secondary windings connected to individual signal conductors 27–29. The connection is such that in the said first signal condition voltage appears on the first signal conductor 27, in the second signal condition voltage appears on the second signal conductor 28 (the voltages across the two primary windings on the transformer 24 in the supply circuit for the signal conductor 27 will cancel each other so that the said conductor will have no voltage), while in the third signal condition the third signal conductor 29 will have voltage. A fourth signal conductor 30 is connected directly to the supply circuit for the lamp 13 and will have voltage in the fourth signal condition.

According to the invention the voltage on each signal conductor is fed selectively to the primary windings of four transformers 31–34. Each transformer has four secondary windings, which are shown only for the transformers 31 and 34 and for these transformers designated 35–38 and 39–42, respectively. These secondary windings on each transformer are coupled through individual rectifiers 43–46 and 47–50, respectively, and following series resistances 51–54 and 55–58, respectively, to a separate input on the code unit, the connection being such that those inputs of the code unit are connected to the secondary windings on one and the same transformer, which according to the selected code shall have voltage in the signal condition, in which the signal conductor connected to the actual transformer has voltage.

The function is that in each signal condition one of the signal conductors will receive voltage, which voltage is transferred to the four associated secondary windings and after rectification will produce dc voltage on four of the inputs of the code unit. This unit then will deliver a reply code, which is characteristic for the signal condition.

In the example two of the inputs, namely 19 and 21, are connected to secondary windings both on the transformer 31 and the transformer 34 through the associated rectifiers 45, 48 and 46, 49 respectively. A short circuiting in any of these rectifiers, however, cannot cause a condition at which dc voltage appearing at such a common input is transferred to another input which is not intended to have voltage, because all inputs as regards dc are completely separated from each other as a result of the transformer feeding. The resistances 51–54 and 55–58, respectively, in the secondary circuits of the transformers result in that ac voltage components neither can be transferred to the secondary windings or another transformer at short circuiting in the rectifiers, because the main part of the ac voltage then will be taken up as a voltage drop in the respective series resistance 51–54, 55–58. An interruption in any of the rectifiers, however, can bring about that an input, which shall have voltage, will loose its voltage.

FIG. 2 shows a modification which can be used in case of signal lamps which are supplied with dc current. In this case a resistance 61 is connected in the supply circuit for a signal lamp 60 and the voltage drop across the resistance 61 is used to drive a transistor oscillator 62. This oscillator delivers its output voltage to a transformer 63 having four secondary windings 64–67. The transformer 63 corresponds to one of the transformers 31–34 in FIG. 1 and a number of such transformers 63 are connected to a code unit in the manner as shown in FIG. 1.

Also in the case of indication lamps supplied with alternating current an oscillator can be utilized for driving the transformers, the oscillators in this case being connected to the respective signal conductor through a rectifier.

What is claimed is:

1. A device for transmitting a coded information about the actual signal condition of a signalling system having a plurality of signal devices, comprising a plurality of ac power sources, a plurality of conductor pairs each being energized from an assigned power source upon actuation of a corresponding signal device, a code unit having a plurality of inputs to produce in response to a voltage condition on respective inputs a coded information to be transmitted, a plurality of separation transformers each having a primary winding connected to an assigned conductor pair and a plurality of separate secondary windings, and a plurality of rectifying means connecting, respectively, said secondary windings to predetermined inputs of said code unit.

2. A device as claimed in claim 1, wherein said power source is an oscillator.

3. An equipment as claimed in claim 1, wherein an impedance is connected in series with each secondary winding for achieving a low coupling between the windings.

4. An equipment as claimed 1, wherein the individual secondary windings on each transformer are arranged on separate legs of a transformer core.

* * * * *